United States Patent [19]

Durrell

[11] Patent Number: 4,475,461

[45] Date of Patent: Oct. 9, 1984

[54] MONOLITHIC MULTI-POINT WARHEAD INITIATOR

[75] Inventor: Robert R. Durrell, Columbia, Md.

[73] Assignee: The United States of America as represented by the Secretary of the Navy, Washington, D.C.

[21] Appl. No.: 274,605

[22] Filed: Jun. 17, 1981

[51] Int. Cl.[3] ..... F42C 19/00

[52] U.S. Cl. ..... 102/200

[58] Field of Search ..... 102/200, 305, 701

[56] References Cited

U.S. PATENT DOCUMENTS

| | | | |
|---|---|---|---|
| 3,430,563 | 3/1969 | Stresau | 102/200 |
| 3,896,731 | 7/1975 | Kilmer | 102/305 |
| 4,145,972 | 3/1979 | Menz et al. | 102/701 |

*Primary Examiner*—Charles T. Jordan

*Attorney, Agent, or Firm*—R. S. Sciascia; A. L. Branning; J. C. LaPrade

[57] ABSTRACT

A monolithic multi-point initiator for a warhead wherein a single detonator is connected by multiple interconnected conduits packed monolithically with an initiator compound that delivers detonating waves to a series of multi-point explosive charges or pellets located at or near either end of the warhead.

12 Claims, 11 Drawing Figures

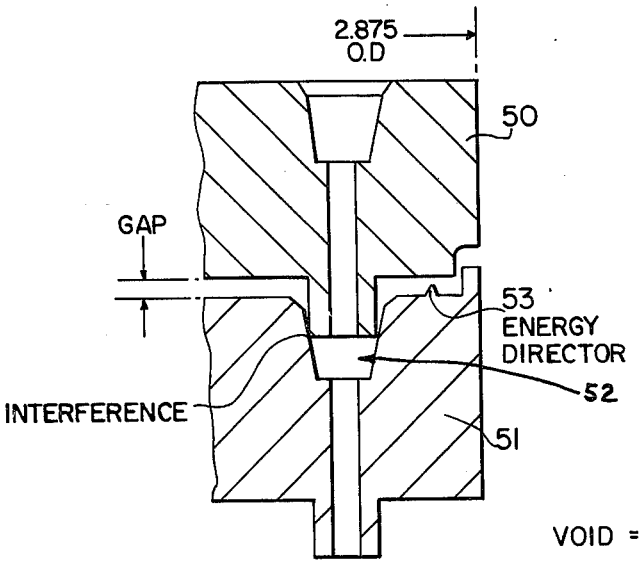
FIG. 7a
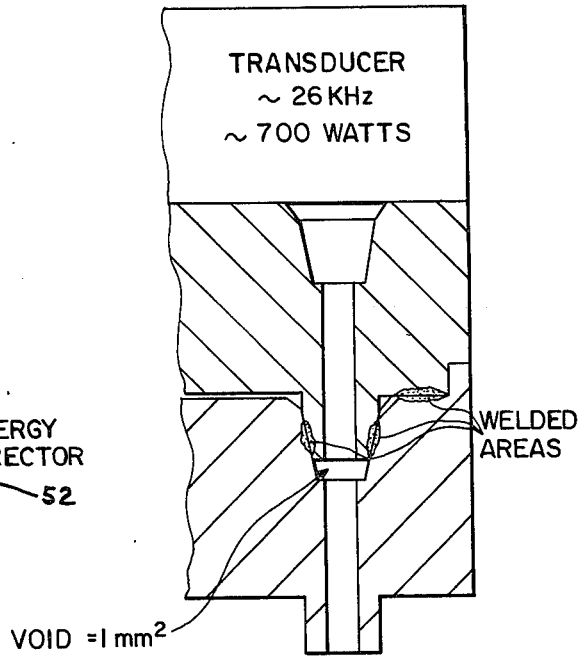
FIG. 7b
FIG. 8
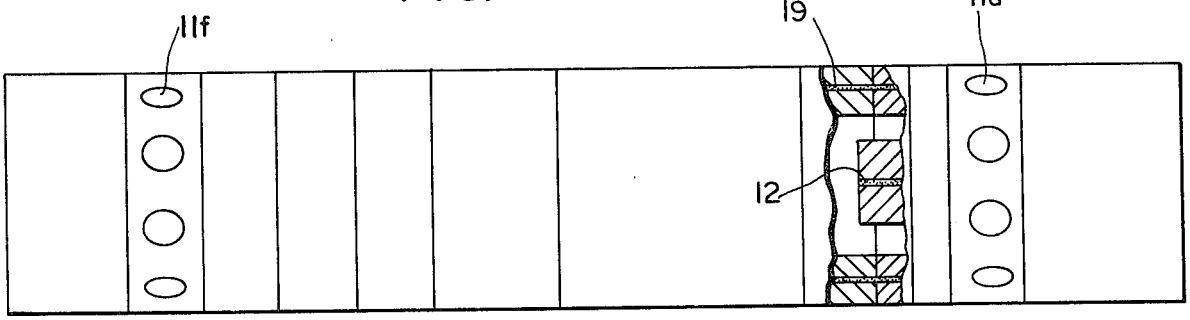
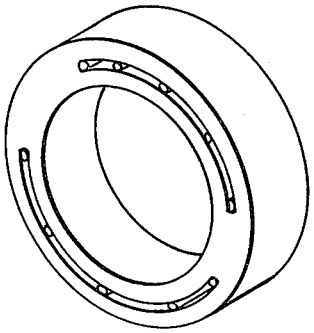
FIG. 9
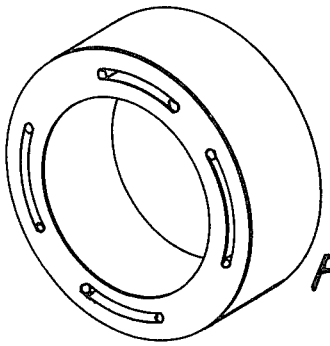
FIG. 10

MONOLITHIC MULTI-POINT WARHEAD INITIATOR

FIELD OF THE INVENTION

This invention relates to warheads and methods and apparatus for initiating the explosion of a warhead. More specifically the invention relates to a novel means of delivering a single explosive wave through monolithic explosive filled multi-path conduits running parallel to the center line axis of the warhead and such conduits being connected to lateral grooves, running essentially at right angles to the center line axis of the warhead, all of the interconnected conduits and grooves being monolithically filled with an explosive initiator material and connecting to multiple explosive charges located near either end or at other distant points around the warhead to control fragmentation of the warhead case.

DESCRIPTION OF THE PRIOR ART

In the prior art dual-end multi-point initiators achieve the required warhead fragmentation focusing by using booster plate assemblies at each end of the warhead. These in turn are interconnected by equal lengths of mild detonating cord (MDC) terminating at a single common explosive input fitting. These MDC cord detonating systems are comparatively complex and expensive. U.S. Patents that utilize the detonating cord with booster plate assembly are Menz et al U.S. Pat. No. 4,145,972, and Kilmer U.S. Pat. No. 3,896,731. In Kilmer each of the multiple booster plates is fitted with a number of explosive terminations. In neither of these patents is a solid monolithic initiator material provided from the booster pellets to the detonator means. In all of the prior art known to the inventor in every mild detonating cord initiating system there are explosive interfaces that are known to have a reduced degree of reliability. The products of all reliability rates determines the minimum reliability of the warhead. Therefore the prior art, utilizing a MDC system with 10 explosive interfaces, each with a 90 percent reliability, would have a net reliability of $0.90\times0.90\times0.90\times0.90\times0.90\times0.90\times0.90\times0.90\times0.90\times0.90$=approximately 40%. In otherwords an explosive signal passing thru 10 explosive interfaces, each being 90% reliable may only arrive at the final point 40 percent of the time. The complexity in fabricating and assembling MDC systems also results in relatively expensive systems since much hand labor is involved. The metal parts required to locate and contain the MDC inherently results in relatively large, bulky and heavy systems.

BRIEF DESCRIPTION OF THE DRAWINGS

FIG. 7*a* is a cross sectional view of a typical joint between two adjacent modules of a monolithic initiator before welding.

FIG. 7*b* illustrates the two adjacent modular blocks after joining, preferably by ultrasonic welding.

FIG. 8 is a partial cross-section of the initiator system showing the arrangement of the modular units.

FIG. 9 is a perspective view of one configuration of one modular unit of the invention.

FIG. 10 is a perspective view of an alternative module unit of the disclosed invention.

OBJECTS OF THE INVENTION

One principal object of the invention is to provide an initiator system for a warhead that is more reliable than prior art systems.

Another object of this invention is to provide a more reliable initiator system at a great reduction in cost.

An additional object of the invention is to provide a one piece monolithic initiator system.

One other important object of this invention is to provide a monolithic initiator system that has only one (1) explosive interface whereas the prior art devices using detonator cord have at least fourteen (14) explosive interfaces.

One additional object of the invention is to provide an initiator system that can be completely preassembled prior to installation in a warhead that allows for simple installation at the depot.

It is another impartial object of this invention to provide an initiator system that is of reduced weight when compared to the prior art.

SUMMARY OF THE INVENTION

The invention provides a monolithic multi-point initiation system consisting only of the booster pellets, a hydra-pattern of the initiation transfer material that is packed in a series of vertical conduits and lateral grooves to provide alternative routes or paths for detonation waves to follow from the detonator means to the multiple explosive pellets located at or near remote ends of the warhead. The hydra-pattern of the initiation transfer material is located within multiple connected vertical conduits and lateral grooves. The lateral channels initially proceed out radially from the initiator input channel that leads from the detonator in four (4) equally spaced apart channels.

DESCRIPTION OF THE PREFERRED EMBODIMENT

Figure 1:
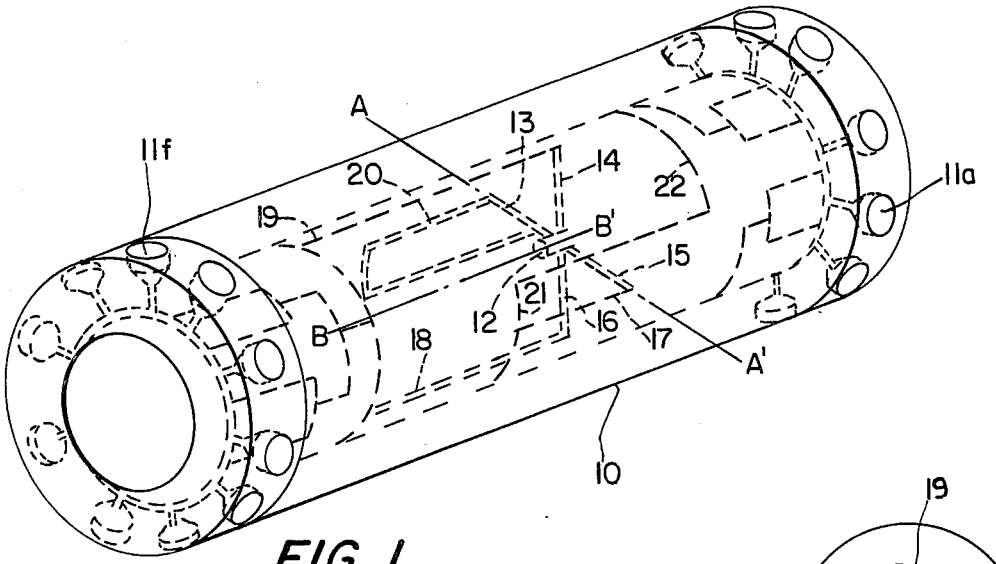
FIG. 1 is a partially cut away perpective view of a monolithically loaded warhead initiator hydra-pattern.

FIG. 1 illustrates a generally cylindrical warhead initiator 10 that is fitted with a radial row of explosive output booster pellets 11(*a*) at the aft end and 11(*f*) at the forward end of the initiator. The output booster pellets are located near either end of the warhead case in the openings designated 11(*a*) or 11(*f*). The initiator input channel 12 is located near the center of the warhead. The hydra-pattern of the initiation transfer material may be PBXN-301 or any other equivalent initiator material that may preferably have the consistency of putty or moist clay. Each of the initial lateral channels, 13, 14, 15 and 16 radiate out from the input channel 12 and each intersects with a vertical conduit 17, 18, 19 and 20. Two of these vertical lines 17 and 20 are also redirected to run toward the aft end of the warhead.

Figure 2:
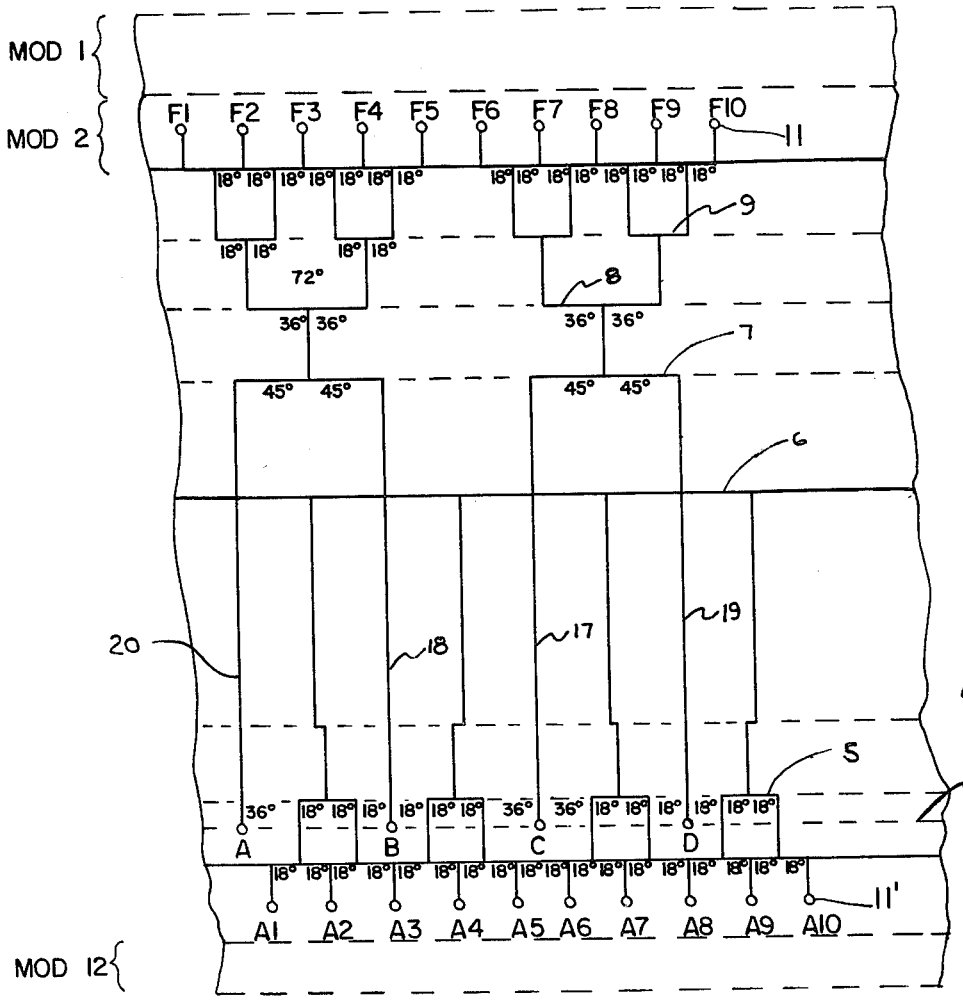
FIG. 2 is a schematic view of the invention's hydra-pattern shown in two dimensions.

FIG. 2 is a flat schematic depiction of the hydra pattern shown in part in FIG. 1. In FIG. 2 the forward booster pellets 11 are designated F1 through F10. The aft booster pellets, designated as A1 through A10. The initial lateral channels 13–16 as shown in FIG. 1 are designated as A, B, C, and D and occur at level 4 in FIG. 2. These four equally spaced apart at 90° angles then intersect with four vertical conduits that are designated as 17, 18, 19, and 20.

FIG. 2 discloses a total of 10 layers between 11 and 11' each of which represents a modules block preferable made of plastic, i.e., lexan, plexiglass, etc. Each of these plastic modules has one or more 0.06 inch vertical conduits and one or more connected lateral grooves having a volume equal to a 0.06 inch diameter conduit. The lateral grooves in a particular modular unit intersect with a number of vertical conduits as best shown in FIG. 9. The lateral grooves, which are filled with a molded explosive such as PBXN301 or an equivalent initiator always appear at the interface between modular blocks such as 4–9.

Figure 3:
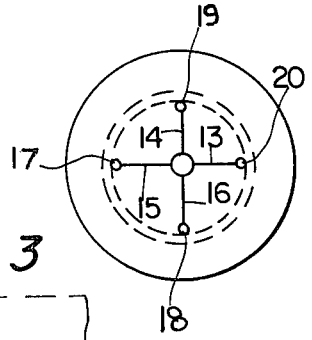
FIG. 3 is a cross-sectional view taken along line A—A' in FIG. 1.

In FIG. 3, a cross sectional view taken along line A—A' of FIG. 1 the lateral conduits 13–16 connect with vertical conduits 17–20. Each of these vertical conduits connect to and eventually intersect with a horizontal groove.

Figures 4, 5, 6:
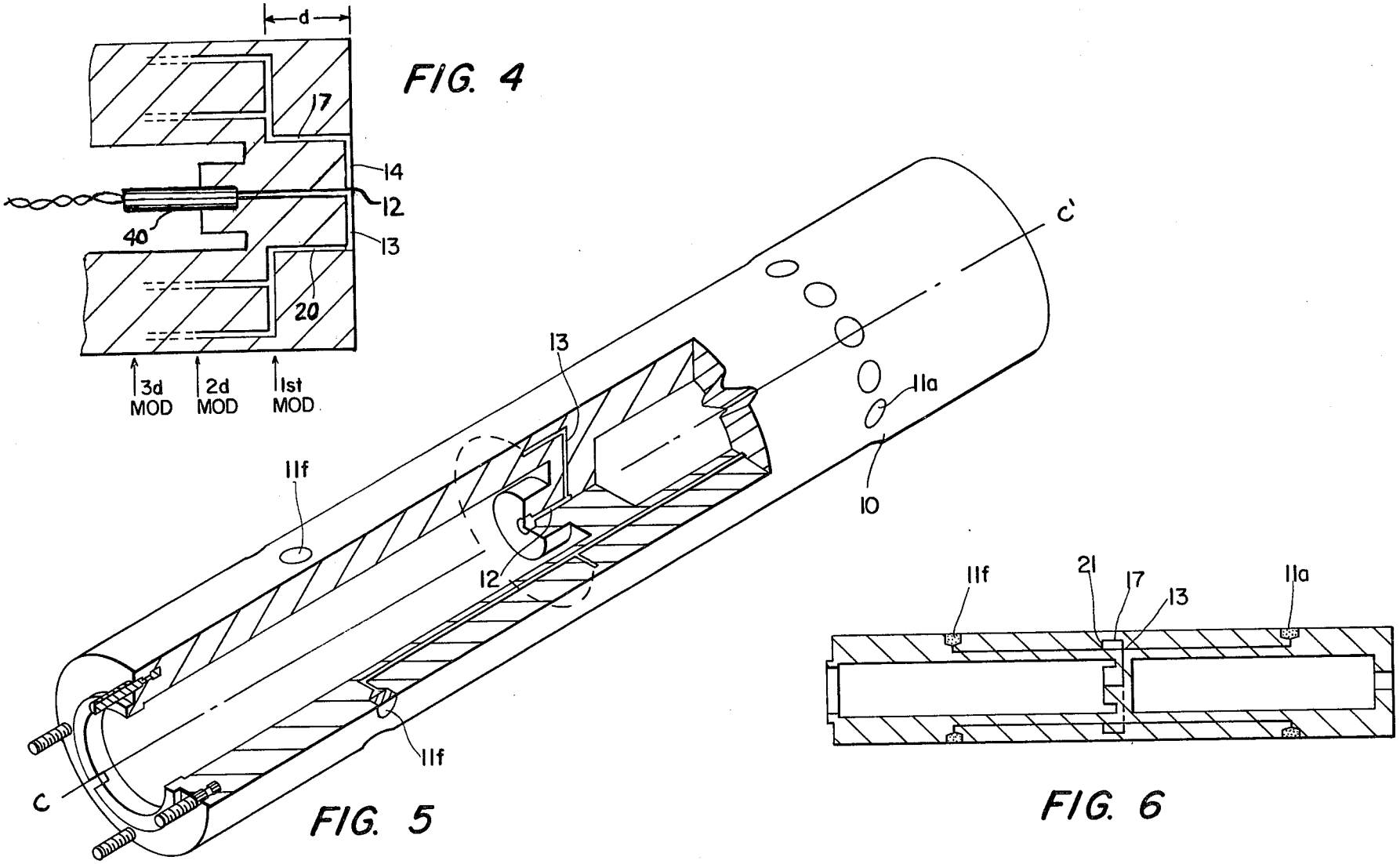
FIG. 4 is cross-sectional view along the line B—B' in FIG. 1.
FIG. 5 is a perspective view of a monolithically loaded warhead initiator, that is partly cut away.
FIG. 6 is a cross-sectional view of a monolithically loaded warhead initiator along line C—C' of FIG. 5.

In FIG. 4, the detonator 40 is connected to an initiator input channel 12 that connects to one of the radial conduits 13–16. The radial conduits connect with the vertical conduits 17–20.

In FIG. 5 the cylindrical initiator assembly 10 that is made of a individually molded Lexan plastic modules is shown as one piece. The cut away section shows the input channel 12 that connects to a radial conduit 13.

In FIG. 6 is a cross-sectional view taken along line C—C' of FIG. 5. The booster pellets 11(*a*) and 11(*f*) are shown connected to a network of vertical conduits such as 13 connected to lateral grooves 21.

In FIG. 7*a* and 7*b* two adjacent modular plastic blocks 50 and 51 are shown prior to and after joining. One preferred method of joining two adjacent modules is ultrasonic welding. The annular groove 52 is welded around its entire periphery. The energy director 53 is a pointed protrusion on one face of one of the modules that provides additional tensile strength.

FIG. 8 shows the relationship of the twelve (12) modular blocks. This figure illustrates the single input channel running from the detonator and connecting with a plurality of radial conduits. Each of these lateral channels are then connected at essentially right angles to four vertically oriented conduits that are generally parallel to the center line longitudinal axis of the warhead. Each of the four vertically oriented conduits intersects a lateral, generally horizontal channel that develops into two vertical conduits, thus doubling in quantity to eight the number of paths to the explosive booster pellets. Of these eight vertical paths four proceed forward and four proceed aft to another annular channel at which point they again double in quantity etc., until they finally reach the radial paths terminating at the booster pellets. In this manner a continuous hydra-pattern consisting of two completely redundant paths to each booster pellet is formed.

The most feasible method of producing a warhead with a hydra-pattern initiator system of the type disclosed is by welding or otherwise laminating and securing a number of modular blocks together, each of said blocks containing a number of horizontal lateral channels each of said channels intersecting one or more vertical conduits so as to form an intergral pattern of vertical conduits and horizontal channels packed with a monolithic explosive initiator compound that may have the consistency of putty. For example, PBXN 301 is a mixture of approximately 80% pentaerythritol tetranitrate (PENTN) and 20% silicon resin (sylgard 182), as defined on pages 4 and 5 of TP 5615 published by the Navel Weapons Center, China Lake, Calif. in October of 1974.

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. In an elongated warhead initiator system fitted with a plurality of booster pellets arranged around the outside circumferential area of the warhead initiator with a centrally located detonator means, the improvement comprising a monolithic, unitary initiation network with initiation material located in a first lateral groove that interfaces contiguous with and adjacent to each said booster pellet and a plurality of vertical conduits and lateral grooves that connect the first lateral groove to a single detonation input conduit located in the midsection of the warhead.

2. The warhead initiator of claim 1 wherein the input conduit is parallel to the axis of the warhead and is connected to a plurality of radial conduits that intersect with a lateral groove.

3. The warhead initiator of claim 1 wherein the number of vertical conduits increase with each succeeding lateral groove so as to increase the number of lateral units to each booster pellet.

4. The warhead initiator of claim 1 wherein each groove and conduit is filled with a plastic extruded explosive material so as to form a monolithic initiation path from the single detonator to each booster pellet.

5. The warhead initiator of claim 1 wherein each groove and each conduit is filled with any plastic bonded explosive of the PBXN301 type.

6. The warhead initiator system of claim 1 wherein a number of modular units are assembled, each containing one or more lateral grooves and one of more vertical conduits that are interconnected.

7. A warhead initiator system with detonator means comprised of a series of modular blocks with booster pellets wherein a first modular block contains at least one annular groove and one vertical conduit that connect with either an annular groove or vertical conduits in the adjacent modular block so as to form a network of lateral grooves and vertical conduits connecting the booster pellets to the centrally located detonator means.

8. A warhead initiator comprised of a series of modular blocks wherein one or more blocks contains openings for booster pellets and a first annual groove adjacent to the pellets and each connected block is fitted with at least one annular groove connected to and intersecting with at least one vertical conduit connecting the first annular groove by a network of vertical conduits and annular grooves to a single detonator.

9. The warhead initiator of claim 8 wherein the network of grooves and conduits is filled with a plastic extruded explosive.

10. The warhead initiator of claim 8 wherein booster pellets are located around the entire circumference near both ends of an elongated cylindrical warhead initiator.

11. The warhead initiation network of claim 8 wherein multiple conduits run vertically to booster pellets located near both ends of the warhead.

12. The warhead of claim 8 wherein the vertical conduits from the booster pellets near both ends of the warhead to the detonator means are essentially equal in length.

* * * * *